US006806693B1

(12) United States Patent
Bron

(10) Patent No.: US 6,806,693 B1
(45) Date of Patent: Oct. 19, 2004

(54) METHOD AND SYSTEM FOR IMPROVING QUIESCENT CURRENTS AT LOW OUTPUT CURRENT LEVELS

(75) Inventor: Ernest Armand Bron, Schijndel (NL)

(73) Assignee: National Semiconductor Corporation, Santa Clara, CA (US)

( * ) Notice: Subject to any disclaimer, the term of this patent is extended or adjusted under 35 U.S.C. 154(b) by 32 days.

(21) Appl. No.: 10/412,960

(22) Filed: Apr. 14, 2003

(51) Int. Cl.[7] ..... G05F 1/56
(52) U.S. Cl. ..... 323/280
(58) Field of Search ..... 323/273, 280, 323/281

(56) References Cited

U.S. PATENT DOCUMENTS

| | | | | |
|---|---|---|---|---|
| 5,989,620 | A * | 11/1999 | Wang et al. | 426/634 |
| 6,611,132 | B2 * | 8/2003 | Nakagawa et al. | 323/284 |
| 6,703,813 | B1 * | 3/2004 | Vladislav et al. | 323/270 |
| 6,703,816 | B2 * | 3/2004 | Biagi et al. | 323/280 |
| 6,710,583 | B2 * | 3/2004 | Stanescu et al. | 323/280 |
| 6,759,836 | B1 * | 7/2004 | Black, Jr. | 323/288 |
| 2003/0111987 | A1 * | 6/2003 | Chen et al. | 323/282 |
| 2003/0214275 | A1 * | 11/2003 | Biagi | 323/280 |

OTHER PUBLICATIONS

"LP3985 Micropower, 150mA Low–Noise Ultra Low–Dropout CMOS Voltage Regulator," *National Semiconductor Corporation 2003*, 17 pages.

* cited by examiner

*Primary Examiner*—Adolf Berhane
(74) *Attorney, Agent, or Firm*—Brett A. Hertzberg; Merchant & Gould PC

(57) ABSTRACT

An oscillator circuit is coupled to an enable pin of an Voltage regulator so that total power consumption is minimized in the application. A filter capacitor is coupled to the Voltage regulator such that current is supplied to the load (the application) while the Voltage regulator is disabled. The frequency of the oscillator circuit is low such that power consumption by the oscillator is minimal. The duty cycle (DC) of the oscillator circuit is selected so that the output voltage across the load does not drop below minimum voltage requirements in the application. The total current (I) that is consumed by the system corresponds to: I=DC*Idq+(1−DC)*Iq+Iosc+Iapp, where Iq corresponds to the shut-down current of the LDO, Idq is the ground current of the LDO, Iosc is the oscillator operating current, and Iapp is the average current consumed by the application.

20 Claims, 3 Drawing Sheets

METHOD AND SYSTEM FOR IMPROVING QUIESCENT CURRENTS AT LOW OUTPUT CURRENT LEVELS

FIELD OF THE INVENTION

The present invention is related to minimizing the operating current of a circuit. More particularly, the present invention is related to a method and system for reducing the operating current of a voltage regulator by periodically disabling the voltage regulator with an oscillator circuit.

BACKGROUND OF THE INVENTION

Demand for portable electronic devices is increasing each year. Example portable electronic devices include: laptop computers, personal data assistants (PDAs), cellular telephones, and electronic pagers. Most portable electronic devices are powered by batteries. Portable electronic devices place high importance on total weight, size, and battery life for the devices.

Although battery technology has improved over the years, the total weight associated with the portable electronic device is greatly affected by the weight associated with the battery. As current consumption requirements increase, additional or larger batteries are required to supply the additional energy to power the device. Thus, there is always a tradeoff between the weight associated with the battery and the total use time associated with the portable electronic device.

Voltage regulators are often used in portable electronics to maintain the operating voltage at a relatively constant level. Some regulators have a high "drop-out" voltage. A "drop-out" voltage corresponds to the difference between the input supply voltage (or unregulated voltage) and the regulated output voltage. Large drop out voltages result in wasted power, and raise the minimum power supply requirements for the electronic device. A low-drop out regulator (hereinafter referred to as an "LDO regulator") is a particular type of voltage regulator that is useful in applications where the input supply voltage is relatively close to the desired regulated supply voltage.

A typical LDO regulator (XLDO) is illustrated in FIG. 1. The LDO regulator (XLDO) includes a voltage control circuit (XVC), a transistor (MREG), and two resistors (R1, R2). Voltage control circuit XVC controls transistor MREG via control signal CTL. Resistor R1 and R2 provide a feedback signal (SENSE) that is compared to a reference voltage (VREF) by the voltage control circuit (XVC). The output voltage (VOUT) is provided to a load circuit (ZL). A capacitor (COUT) can be connected in parallel to the load circuit to provide filtering of supply ripple in the output voltage (VOUT).

BRIEF DESCRIPTION OF THE DRAWINGS

Non-limiting and non-exhaustive embodiments of the present invention are described with reference to the following drawings.

DETAILED DESCRIPTION OF THE PREFERRED EMBODIMENT

Figure 1:
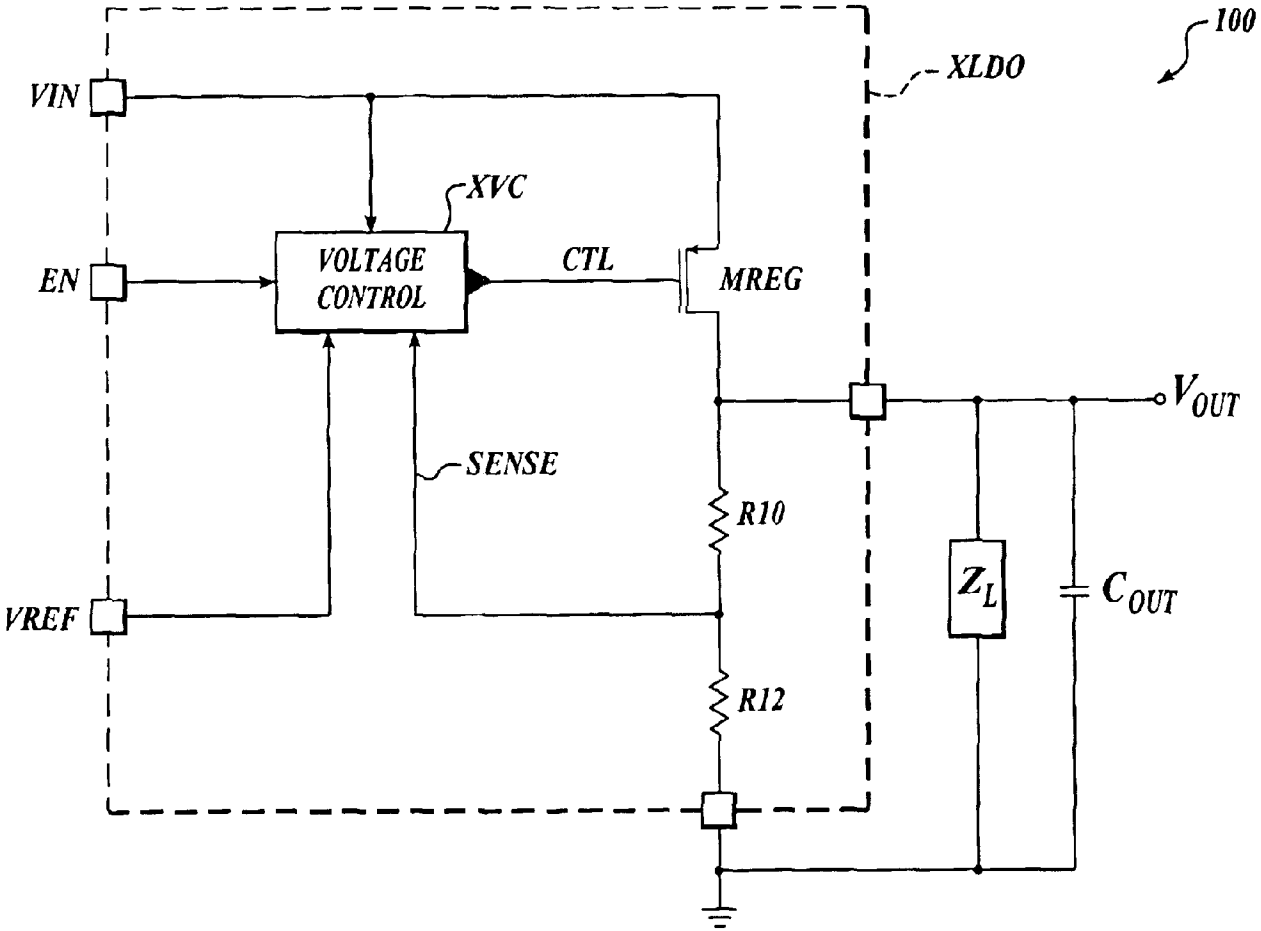
FIG. 1 is an illustration of a schematic diagram for a conventional LDO regulator.

Throughout the specification and claims, the following terms take the meanings explicitly associated herein, unless the context clearly dictates otherwise. The meanings identified below are not intended to limit the terms, but merely provide illustrative examples for the terms. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, charge, temperature, or data signal. Referring to the drawings, like numbers indicate like parts throughout the views.

Briefly stated, the present invention is related to a method and apparatus for reducing the total power consumption in an application circuit. An oscillator circuit is coupled to an enable pin of a voltage regulator so that total power consumption is minimized in the application. A filter capacitor is coupled to the voltage regulator such that current is supplied to the load (the application) while the voltage regulator is disabled. The frequency of the oscillator circuit is low such that power consumption by the oscillator is minimal. The duty cycle (DC) of the oscillator circuit is selected so that the output voltage across the load does not drop below minimum voltage requirements in the application. The total current (I) that is consumed by the entire system includes the current that is consumed by the application circuit, the voltage regulator, and the oscillator circuit. The total current may be expressed as: $I=DC*Idq+(1-DC)*Iq+Iosc+Iapp$, where Iq corresponds to the shutdown current of the voltage regulator, Idq is the ground current of the voltage regulator, Iosc is the oscillator operating current, and Iapp is the average current consumed by the application.

A voltage regulator can be configured for use in a specific application such that specific performance parameters for the application are optimized. Example performance parameters include low noise operation, load regulation, ripple, etc. One specific parameter is referred to as ground current. Ground current refers to the minimum operating current that the voltage regulator requires to maintain regulation. An application circuit is connected to the output of the voltage regulator, drawing an output current.

In some instances, the output current that is required by the application circuit is very low. For most portable electronic devices, it is desirable to extend the battery life as long as possible by operating the device in a standby mode when the device is suspended from normal operation (e.g., a standby mode in a cellular telephone). In the standby mode, the application circuit (e.g., an LCD, user interface, and transceiver in a cellular telephone) operates on very low current (e.g., 1 $\mu$A–3 $\mu$A). Typical voltage regulators may consume 100 $\mu$A or more, which is a waste of energy for such low current application requirements. The present invention utilizes periodic activation of a voltage regulator to reduce the ground current requirements in the overall system design when the system is in standby operating mode. The voltage regulator can be fully activated when the application circuit requires an active operating mode.

Figure 2:
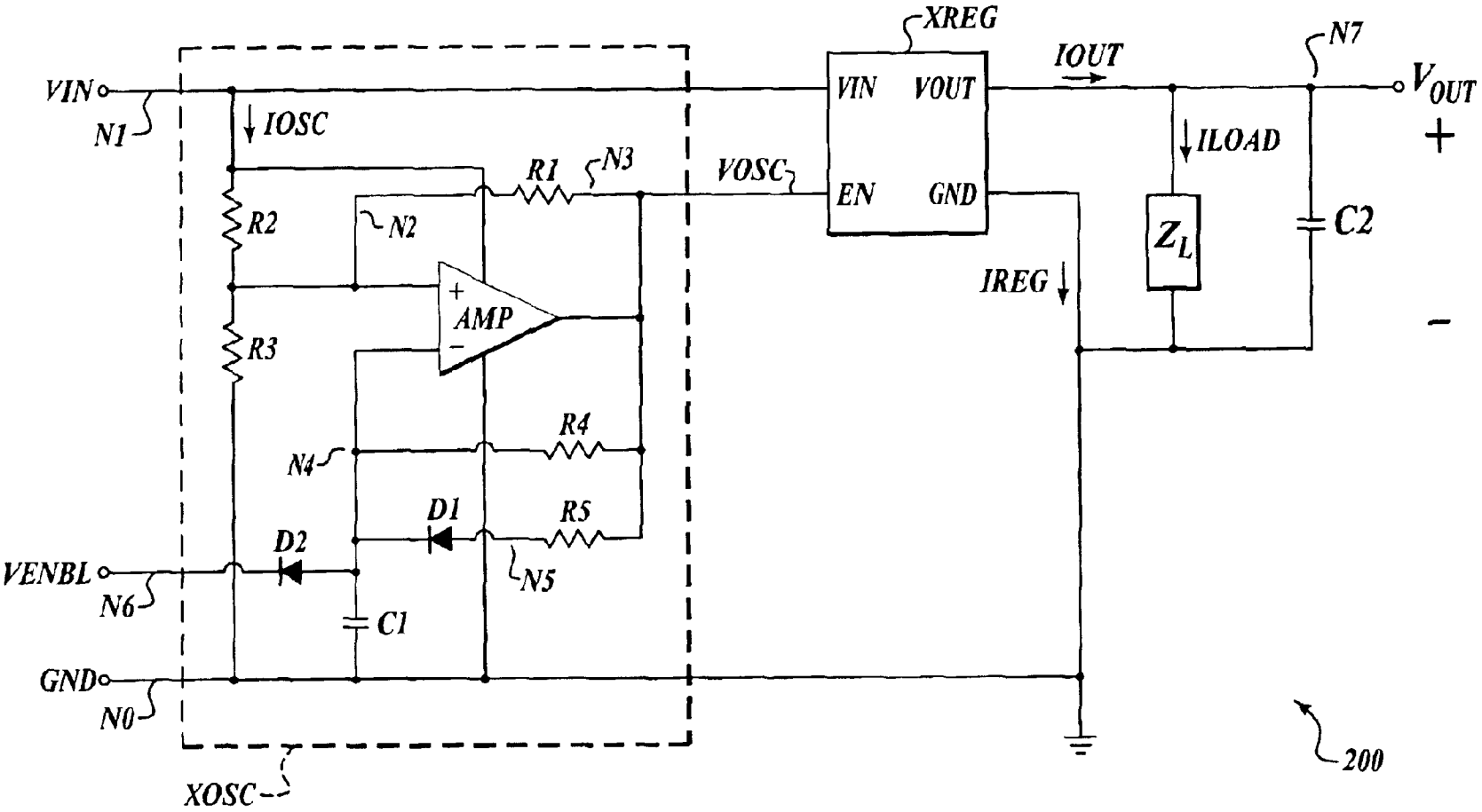
FIG. 2 is an illustration of a schematic diagram for a voltage regulator based system that is arranged according to an embodiment of the present invention.

FIG. 2 is an illustration of a schematic diagram for a voltage regulator based system that is arranged according to an embodiment of the present invention. The system (200) includes an oscillator circuit (XOSC), a voltage regulator (XREG), an application circuit (ZL), and an output filter capacitor (C2).

The oscillator circuit (XOSC) includes an input power terminal at node N1, an enable terminal at node N6, a ground terminal at node N0, and an oscillator output terminal at node N3. The voltage regulator (XREG) includes an input power terminal at node N1, an enable terminal at node N3, a ground terminal at node N0, and a regulator output terminal at node N7. The application circuit (ZL) and the output filter capacitor are coupled between nodes N7 and N0. In operation, an enable signal (VENB) is coupled to node N6, an input power signal (VIN) is coupled to node N1, and a ground signal (GND) is coupled to node N0. Oscillator circuit XOSC provides an oscillator signal (VOSC) at node N3 when activated in response to the enable signal (VENBL). Voltage regulator XREG provides current to the application circuit (ZL) when the voltage regulator is enabled by the oscillator signal (VOSC). Capacitor C2 provides a temporary current supply to application circuit ZL when voltage regulator XREG is disabled. An output voltage (VOUT) is present across the application circuit (ZL).

Voltage regulator XREG is disabled for most of the time when the application circuit (ZL) is in the standby operating mode. While disabled, the voltage regulator (XREG) does not provide any output current, and consumes very little current internally. The output of the oscillator (VOSC) is used to switch the voltage regulator (XREG) on and off at regular intervals. The voltage regulator (XREG) is arranged to provide current to the application circuit (ZL) and to the output filter capacitor (C2) when the voltage regulator (XREG) is enabled. Output filter capacitor C2 stores charge while the voltage regulator (XREG) is enabled such that the application circuit (ZL) is sufficiently powered by the output filter capacitor (C2) when the voltage regulator (XREG) is disabled. Average power consumption for the voltage regulator (XREG) is reduced by periodic activation of the voltage regulator (XREG) when the system is in the standby operating-mode.

The voltage regulator (XREG) may be implemented as any type of voltage regulator that can be selectively activated. In one example, the voltage regulator corresponds to a linear regulator such as an LDO regulator. However, the methodologies discussed herein are not limited to linear voltage regulators. The selection of the voltage regulator is application specific based on any desired parameter such as ripple rejection, power-supply rejection, drop-out voltage, output current, operating current, standby current, as well as other parameters.

The oscillator circuit (XOSC) that is illustrated in FIG. 2 includes five resistors (R1–R5), two diodes (D1–D2), a capacitor (C1) and an amplifier (AMP). Resistor R1 is coupled between nodes N2 and N3. Resistor R2 is coupled between nodes N1 and N2. Resistor R3 is coupled between nodes N2 and N0. Resistor R4 is coupled between nodes N3 and N4. Resistor R5 is coupled between nodes N3 and N5. Diode D1 is coupled between nodes N5 and N4. Diode D2 is coupled between nodes N4 and N6. Capacitor C1 is coupled between nodes N4 and N0. Amplifier AMP includes a non-inverting input terminal that is coupled to node N2, an inverting input terminal that is coupled to node N4, and an output terminal that is coupled to node N3.

Oscillator circuit XOSC is illustrated as a relaxation oscillator that is arranged to operate with a duty cycle that is controlled by the charging and discharging rate of capacitor C1. Capacitor C1 is charged by the amplifier through the parallel combination of resistors R4 and R5, while capacitor C2 is discharged by the amplifier through resistor R4. Diode D2 is used to disabled the oscillator when the VENBL signal is low, and enables the oscillator when the VENBL signal is high. Diode D1 and resistor R5 ensure that capacitor C1 is charged at a rate that is different from the discharge rate. Increased values for resistor R5 will increase the on-time (TON) for the voltage regulator (XREG), while increased values for resistor R4 will increase the off-time (TOFF) for the voltage regulator (XREG). The charging and discharging time is also dependent on the value for capacitor C1. Increased values for capacitor C1 will increase both the on-time (TON) and the off-time (TOFF). The value of the capacitors and the resistors are selected to provide a duty cycle that is sufficient to power the application circuit, while maintaining minimum power consumption.

The oscillator may be implemented as any type of oscillator that can be selectively activated by an enable signal. For the example illustrated in FIG. 3, the oscillator corresponds to a relaxation oscillator. However, the methodologies discussed herein are not limited to relaxation oscillators. Any appropriate oscillator circuit can be selected based on various criteria such as power consumption, operating frequency, duty cycle, operating current, standby operating current, noise immunity, as well as any other criteria. Moreover, the de-activation mechanism in the oscillator circuit is not limited oscillators that are selectively disabled by applying an enable signal to a diode. Any appropriate mechanism may be employed such that the output signal from the oscillator is toggled between an oscillating state, and a non-oscillating state.

Figure 3:
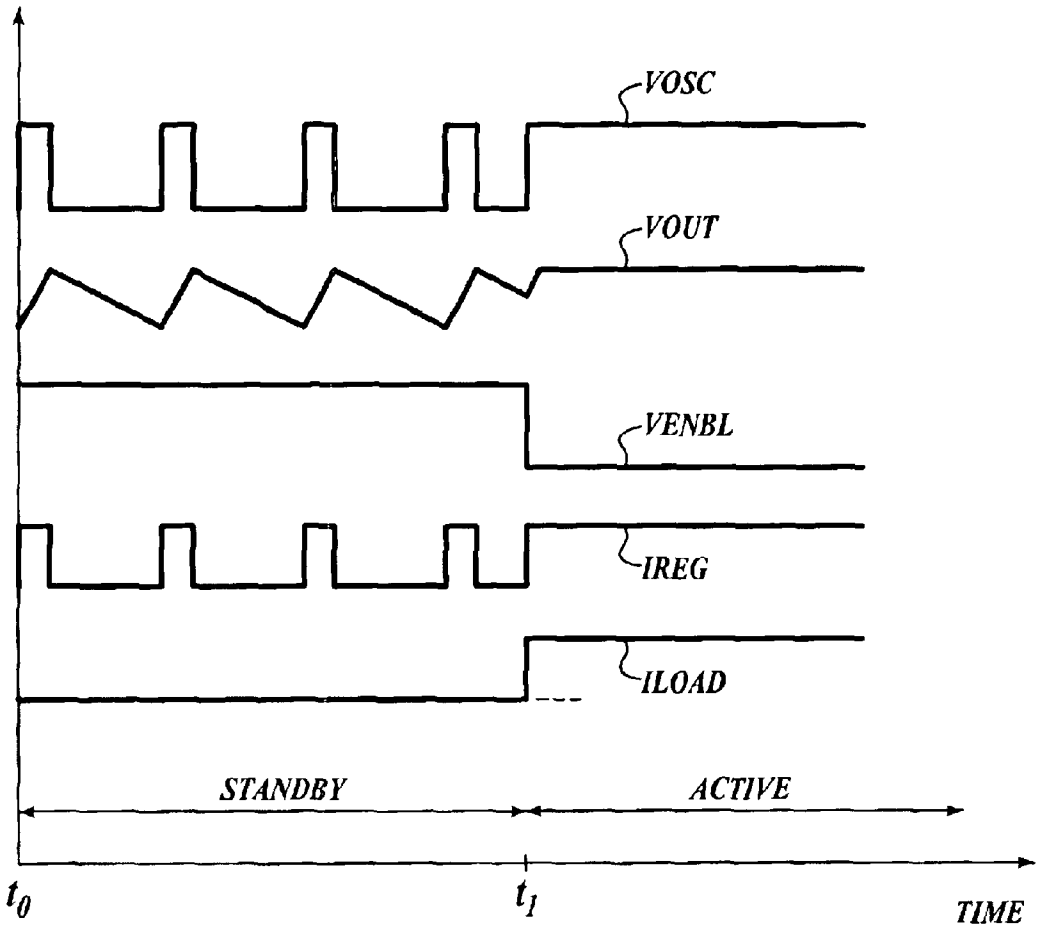
FIG. 3 is an illustration of a transient response for an example regulator based system that is arranged according to of an embodiment of the present invention.

FIG. 3 is an illustration of a transient response for an example voltage regulator based system that is arranged according to of an embodiment of the present invention. From time t0 through time t1 the system is operated in a standby operating mode, while the system is operated in an active operating mode after time t1. The duty cycle of the oscillator output voltage (VOSC) is far below 50% during the standby operating mode. After time t1, the oscillator is disabled and voltage regulator (XREG) is always enabled. The enable signal (VENBL) is high while the application circuit is operated in the standby operating mode and low when the application circuit is operated in the active operating mode.

During the standby operating mode, the output voltage (VOUT) across the application circuit (ZL) appears as a saw-tooth waveform that decreases while the voltage regulator (XREG) is disabled, and increases while the voltage regulator (XREG) is enabled. The output voltage increases rapidly while the voltage regulator is enabled, charging capacitor C2 and supplying current to the application circuit (ZL). The output voltage will increase until the desired regulation voltage is reached or until the voltage regulator (XREG) is disabled.

As illustrated in FIG. 3, the voltage regulator current (IREG) is minimal when the voltage regulator is disabled, and peaks when the voltage regulator is enabled. The application circuit current consumption (IAPP) is stable during the standby operating mode, which is direct result of the current that is supplied to the application circuit from capacitor C2. The total current consumption corresponds to the sum of IREG and IAPP. The application circuit current consumption and the voltage regulator current consumption both increase to a constant level when the system is operated in the active operating mode. The voltage regulator can be selected to operate at higher current levels to improve the noise immunity and ripple rejection.

The maximum actual current savings that is attainable for the overall system is dependent on the realized duty cycle of oscillator circuit (XOSC). The power savings increase as the duty cycle becomes lower as a result of the reduced current consumption by the voltage regulator (XREG).

A conventional voltage regulator based system has a current consumption (I) that is determined as follows: I=Idq+Iapp, where Idq is the ground current for the voltage regulator, and Iapp is the application circuits average current consumption. In contrast, the oscillator controlled voltage regulator that is employed by the present invention yields a current consumption (I) that is given by: I=DC*Idq+(1−DC)*Iq+Iosc+Iapp, where DC is the duty cycle of the oscillator circuit, Iq is the shutdown current of the voltage regulator, and Iosc is the oscillator operational current.

The duty cycle of the oscillator cannot be reduced indefinitely, and is bounded by the minimum operating voltage that is required by the application circuit. The maximum off-time (TOFF) and the minimum on-time (TON) are bounded by the selected output filter capacitor and the charging capability of the voltage regulator, and the required application circuit operating current.

The power savings that can achieved by the present invention are illustrated follows. The operating currents for an example voltage regulator, an example application circuit, and an example oscillator circuit correspond to:

Iapp=100 μA

Idq=80 μA

Iq=2 μA

Iosc=2 μA

Vout (nominal)=3.3V

Vout (min)=3.0V

C2=2 μF.

Capacitor C2 is discharged at a rate that is determined by the amount of current that is drained from capacitor C2. As described above, the application circuit is presenting a load of 100 μA, and the output voltage decreases a maximum of 300 m V while the voltage regulator is disabled. For this example, the maximum off-time (TOFF) for the voltage regulator is 6 ms. The on-time (TON) depends on the minimum turn on delay of the voltage and the time it takes to charge up capacitor C2. Assuming a minimum turn-on delay of 200 μs, an on-time (TON) of 1 ms should be sufficient to charge capacitor C2 to the nominal output voltage of 3.3V. A resulting duty cycle of 0.167 is realized by this example. The average current consumption that is achieved by this example corresponds to: I=0.167*80 μA+0.833*2 μA+2 μA+100 μA=117 μA. A conventional voltage regulator based system that does not benefit from the present invention would consume a current of: I=100 μA+80 μA=180 μA. An estimated maximum power consumption improvement of 35% is realized by this example.

The above specification, examples and data provide a complete description of the present invention. Since many embodiments of the invention can be made without departing from the spirit and scope of the invention, the invention resides in the claims hereinafter appended.

I claim:

1. An apparatus for reducing power requirements in a system that includes an application circuit, the apparatus comprising:

an oscillator circuit, wherein the oscillator circuit includes an input power terminal that is coupled to a first node, a ground terminal that is coupled to a second node, and an oscillator output terminal that is coupled to a third node;

a voltage regulator circuit, wherein the voltage regulator circuit includes an input power terminal that is coupled to the first node, a ground terminal that is coupled to the second node, an enable terminal that is coupled to the third node, and a regulator output terminal that is coupled to a fourth node; and an output filter capacitor, wherein the output filter is coupled between the fourth node and the second node, wherein the application circuit is also coupled between the fourth node and the second node.

2. The apparatus of claim 1, the voltage regulator circuit corresponds to at least one of: a linear regulator and an LDO regulator.

3. The apparatus of claim 1, wherein the oscillator circuit includes an enable terminal that is coupled to a fifth terminal, wherein the enable terminal of the oscillator circuit is capable of receiving an enable signal, and wherein the oscillator circuit is arranged such that the oscillator circuit is selectively activated in response to the enable signal when power is applied to the system across the first and second nodes.

4. The apparatus of claim 3, wherein the enable signal is asserted when the application circuit is operated in a standby operating mode, and wherein the oscillator circuit is arranged in cooperation with the voltage regulator circuit such that the voltage regulator circuit is periodically disabled by the oscillator circuit when the enable signal is asserted.

5. The apparatus of claim 3, wherein the enable signal is de-asserted when the application circuit is operated in an active operating mode, and wherein the oscillator circuit is arranged in cooperation with the voltage regulator circuit such that the voltage regulator circuit is enabled by the oscillator circuit when the enable signal is de-asserted.

6. The apparatus of claim 1, wherein the voltage regulator circuit is arranged to regulate an output voltage across the fourth and second nodes when the voltage regulator circuit is enabled, wherein the voltage regulator circuit is enabled when an enable signal is asserted at the third node and power is applied to the system across the first and second nodes.

7. The apparatus of claim 1, wherein the output filter capacitor is arranged to store charge from the output current when the linear voltage circuit is enabled such that the output filter capacitor provides a current to the application circuit when the voltage regulator circuit is disabled and power is applied to the system across the first and second nodes.

8. The apparatus of claim 1, the oscillator circuit further comprising:

an amplifier circuit, wherein the amplifier circuit includes an output terminal that is coupled to the third node, a first input terminal that is coupled to a fifth node, a second input terminal that is coupled to a sixth node;

a resistor circuit, wherein the resistor circuit is coupled between the third node and the fifth node; and a capacitor circuit, wherein the capacitor circuit is coupled between the fifth node and the second node.

9. The apparatus of claim 7, the resistor circuit further comprising:

a first resistor, wherein the first resistor is coupled between the third node and the fifth node;

a second resistor, wherein the second resistor is coupled between the third node and the seventh node; and a diode, wherein the diode is coupled between the seventh node and the fifth node.

10. The apparatus of claim 8, the oscillator circuit further comprising: a diode circuit that is coupled between the fifth node and a seventh node, wherein the seventh node is capable of receiving an enable signal such that the oscillator circuit is selectively enabled in response to the enable signal when power is applied across the first and second nodes.

11. The apparatus of claim 8, wherein the oscillator circuit corresponds to a relaxation oscillator.

12. The apparatus of claim 8, wherein the capacitor is arranged to charge at a first rate and discharge at a second rate when the oscillator circuit is active, wherein a frequency and a duty cycle that is associated with the oscillator circuit is adjusted by changing values associated with the resistor circuit and the capacitor circuit.

13. The apparatus of claim 1, wherein the apparatus is arranged to operate on a total operating current (I) when power is applied to the system across the first and second nodes, wherein the total operating current is approximately given by:

$$I=DC*Idq+(1-DC)*Iq+Iosc+Iapp,$$

where Idq is a ground current of the voltage regulator circuit, Iq is a shutdown current of the voltage regulator circuit, Iosc is an operating current of the oscillator circuit, Iapp is an average operating current for the application circuit, and DC is a duty cycle that is associated with the oscillator.

14. An apparatus for reducing power requirements in a system that includes an application circuit, the apparatus comprising:

an oscillator means, wherein the oscillator means is arranged to provide an oscillator signal when power is applied to the system;

a regulator means, wherein the regulator means is arranged to provide an output current to an output terminal when enabled such that a voltage associated with the output terminal is regulated, wherein the regulator means is periodically enabled in response to the oscillator signal when power is applied to the system; and a charge storage means, wherein the charge storage means is arranged to store charge from the output current when the regulator means is enabled, and arranged to supply current to the application circuit when the regulator means is disabled.

15. The apparatus of claim 14 wherein the apparatus is arranged to operate on a total operating current (I) when power is applied to the system, wherein the total operating current is given by:

$$I=DC*Idq+(1-DC)*Iq+Iosc+Iapp,$$

where Idq is a ground current of the regulator means, Iq is a shutdown current of the regulator means, Iosc is an operating current of the oscillator means, Iapp is an average operating current for the application circuit, and DC is a duty cycle that is associated with the oscillator signal.

16. The apparatus of claim 14, wherein the regulator means corresponds to at least one of: a linear regulator and an LDO regulator.

17. A method for reducing power requirements in a system that includes an application circuit, the method comprising:

generating a periodic signal when power is applied to the system and the system is in a standby operating mode, wherein the periodic signal has a duty cycle;

enabling a regulator means in response to the periodic signal during a first portion of the duty cycle;

disabling the regulator means in response to the periodic signal during a second portion of the duty cycle;

regulating an output voltage across the application circuit when the voltage regulator means is enabled;

storing charge when the regulator means is enabled to provide a stored charge; and supplying current to the application circuit from the stored charge when the regulator means is disabled.

18. The apparatus of claim 17, wherein the apparatus is arranged to operate on a total operating current (I) when power is applied to the system, wherein the total operating current is given by:

$$I=DC*Idq+(1-DC)*Iq+Iosc+Iapp,$$

where Idq is a ground current of the regulator means, Iq is a shutdown current of the regulator means, Iosc is an operating current of the oscillator means, Iapp is an average operating current for the application circuit, and DC is a duty cycle that is associated with the oscillator signal.

19. The apparatus of claim 17, wherein the regulator means corresponds to at least one of: a linear regulator and an LDO regulator.

20. The apparatus of claim 17, further comprising:

generating an enable signal when power is applied to the system and the system is in an active operating mode; and enabling the regulator means in response to the enable signal.

* * * * *